United States Patent [19]

Schwabe et al.

[11] 4,189,617

[45] Feb. 19, 1980

[54] LIQUID-COOLED ELECTRODE FOR ELECTRIC ARC FURNACES

[75] Inventors: William Schwabe, Cleveland, Ohio; Emil Elsner; Rudolf Kasper, both of Baden-Baden, Fed. Rep. of Germany

[73] Assignee: Korf-Stahl AG, Baden-Baden, Fed. Rep. of Germany

[21] Appl. No.: 921,973

[22] Filed: Jul. 5, 1978

[30] Foreign Application Priority Data

Jul. 8, 1977 [DE] Fed. Rep. of Germany ..... 2730884

[51] Int. Cl.[2] ..... H05B 7/06; H05B 7/10

[52] U.S. Cl. ..... 13/18 C; 13/11

[58] Field of Search ..... 13/11, 14, 15, 16, 17, 13/18 R, 18 A, 18 B, 18 C

[56] References Cited

U.S. PATENT DOCUMENTS

| | | | |
|---|---|---|---|
| 932,368 | 8/1909 | Becket | 13/17 |
| 1,167,176 | 1/1916 | Highfield | 13/18 R X |
| 2,979,550 | 4/1961 | Sherman, Sr. | 13/17 |

*Primary Examiner*—Roy N. Envall, Jr.

[57] ABSTRACT

A liquid-cooled electrode for electric arc furnaces having a cover secured to an electrode supporting arm and containing cooled metal elements and having a core which can be axially displaced in the cover, into which core the electrode current can be conducted by way of a current conection. The current connection is disposed above the cover, while the cover is electrically insulated from the core and the insulation includes an insulating layer between the cover and the core. In addition, a device for producing a magnetic field is provided in the lower portion of the cover.

20 Claims, 4 Drawing Figures

9
15
16
I
I
5
8
11
12
4
13
3
14
2
7
1
19
17
6
18
27
III
28
20
10

LIQUID-COOLED ELECTRODE FOR ELECTRIC ARC FURNACES

The invention relates to a liquid-cooled electrode for electric arc furnaces having a cover secured to the electrode supporting arm and containing cooled metal elements and having a core, which can be axially displaced in the cover and into which the electrode current can be fed by of a current connection.

Electrodes of this kind are known from DE-PS No. 976,617. In order to introduce the electrical energy in the most concentrated manner possible into the actual, generally speaking, spatially small region of the reaction zone and to simultaneously prevent the upper zones of the furnace from being uselessly heated, the electrode current is supplied by a water-cooled metal cover and is only fed into the carbon core at the lower end of the metal cover by way of a current ring. The cooled metal cover protects, for example, the lid of the electric melting furnace from destruction due to overheating while the carbon core can be loaded more strongly in the region of the tip projecting from the metal cover. Axial displacement of the carbon core is carried out by a screw-coupling. To this end an external thread is mounted on a carbon core while the current ring and the holder for the carbon core have an internal thread.

The disadvantage of the known electrode is that the liquid-cooled metal cover is electrically connected to the high current source supplying the electrode current. This gives rise to the risk of arc-backs occurring between the liquid-cooled metal cover and the metallic charge of the arc furnace, which damages the cooling system and through which the emerging liquid can enter the furnace vessel. This can then lead to explosions which do not merely result in damage to the furnace.

U.S. Pat. No. 3,395,240 discloses a liquid-cooled electrode with a non-consumable water-cooled tip over which the arc is moved by a magnetic field. The core comprises a conduit system for the cooling liquid bearing the electrode current, which is helically designed in the lower region to produce the magnetic field. The conduit system is enclosed in a cover, which contains an additional conduit system for the cooling liquid, this second system being protected from the furnace chamber by fire-proof material. The conduit system of the electrode core is secured to the cover in a predetermined position and electrically insulated from it by way of sleeves made of to insulating material and by a cross bar.

The disadvantage of this electrode is that the magnetic field which causes the arc to move is firmly predetermined by the coil of the cooling system and permits no adaptation of any kind to the prevailing circumstances. After assembly of the electrode the mutual spatial co-ordination with the liquid-cooled cover serving as a heat shield is also determined so that the cooling conditions and their mechanical and thermal protection can no longer be adapted to the individual circumstances by the cover. These disadvantages are particularly prevalent in the case of liquid-cooled electrodes with consumable tips, which require constant readjustment both of the magnetic field and of the exposed portion of the tip.

U.S. Pat. No. 3,530,223 discloses a method whereby in the case of a consumable electrode a device for producing a magnetic field can be provided which causes the arc to move over the electrode tip and to thereby achieve a more even consumption and a longer operational lifetime of the consumable electrode. The magnetic field is produced by a liquid-cooled coil which surrounds the consumable electrode in the lower region and can be displaced coaxially to the electrode. The axial displacement of the coil permits the coil to be aligned with the tip of the consumable electrode. The coil is suspended by a plurality of tubes which are ducted to the outside through the lid.

The disadvantage of this solution is that the electrode is exposed and unprotected over almost its entire length and that pieces of scrap metal can be caught up in the supporting structure, which not only subject the supporting structure to mechanical stress but also conduct fault currents through the supporting structure, which can result in the melting of the liquid circuits and the leaking of the cooling liquid.

The object of the invention is to avoid the aforementioned disadvantages of the known electrodes. The aim is not only to achieve adequate mechanical protection so that even in the face of the great mechanical stresses to which the electrode is subjected, as with scrap collapse, electrode rupture is prevented with consumable electrodes or damage to permanent electrodes is prevented, but in addition to avoid arc-backs between the cover of the electrodes and the metallic charge of the electric arc furnace or fault currents through the cover which could damage the cooling system. Furthermore, adequate external protection against radiation and heat should be provided in order to keep the loss of heat through the cooling system of the electrodes at the lowest possible level. The spatial co-ordination between a device for producing a magnetic field and the tip of the electrode core should be able to be easily adjusted.

A solution is provided in respect of an electrode of the kind mentioned at the outset in that the current connection is disposed above the cover, that the cover is electrically insulated from the core and the insulation includes an insulating layer between the cover and the core and that in addition a device for producing a magnetic field is provided in the lower portion of the cover.

The electrode in accordance with the invention contains a core carrying the electrode current and a cover secured to the electrode holder, both designed as independent components, said cover having in its lower region a device for producing a magnetic field, by means of which device the arc is moved over the tip of the core. The spatial co-ordination between the magnet and the core tip, i.e. the optimum spatial position of the electrode tip in the magnetic field causing the movement of the arc, can be simply adjusted by the axial displacement of the core. In this way, depending upon whether a permanent magnet or one excited by current is used, the optimum tip position can be easily adjusted even with varying forms of magnetic fields and this position can then be secured for example by firmly connecting the two components. In the event of repair works the individual parts of the electrode are easily accessible and with replacement in every case only the respective damaged parts need be replaced.

A sliding connection between the two components, i.e. between the cover and the core, permits the constant alteration of the reciprocal position. This is of particular interest when the core carrying the electrode current is made of consumable material because then the degree of projection of the core tip from the cover protecting the core can be adjusted to the optimum and also continuously readjusted with the constant consumption of the electrode tip. The insulating layer between the core carrying the electrode current and the cover containing the metal elements enables the cover to be electrically separated from the core carrying the electrode current in a very simple manner so that arc-backs or fault currents between the cover and the metallic charge of the electric arc furnace can no longer occur.

The invention is described in more detail by way of two embodiments with the aid of the attached drawing, wherein FIG. 1 shows an electrode in accordance with the invention in partial longitudinal section along the line I—I of FIG. 2;

Figure 1:
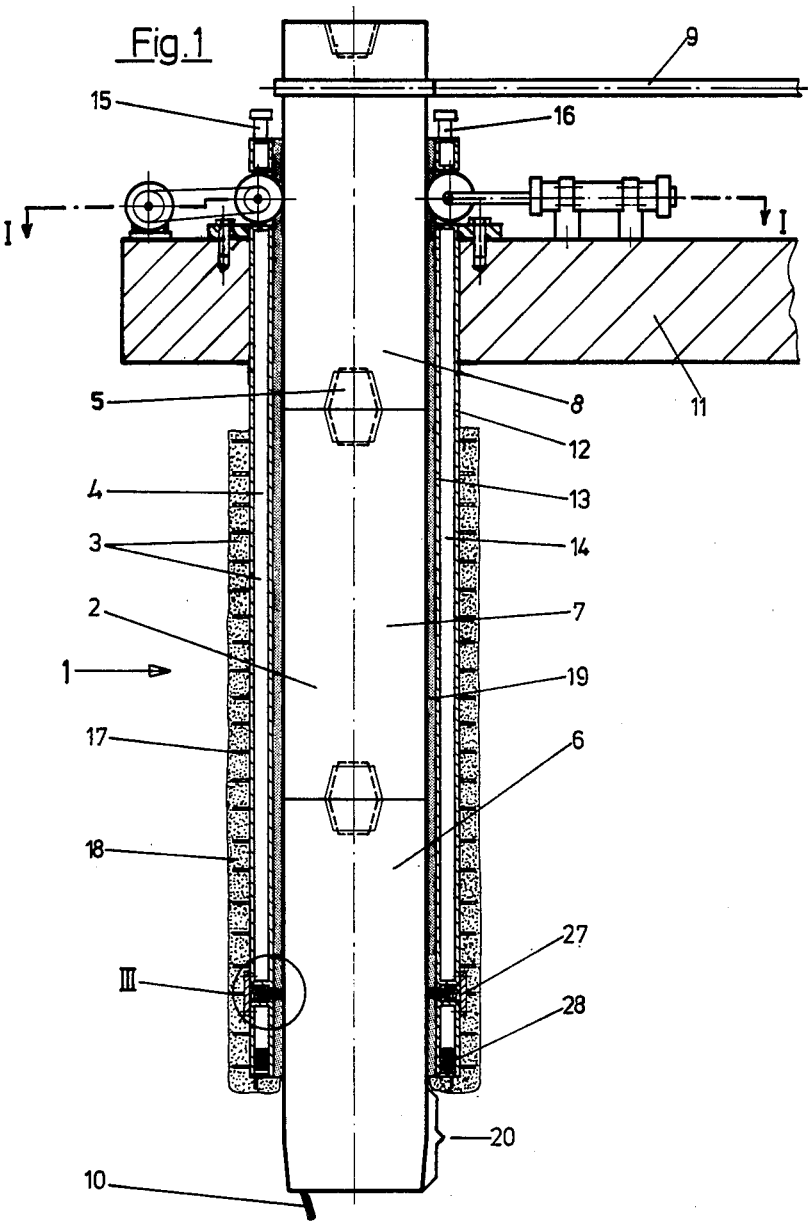
Figure 2:
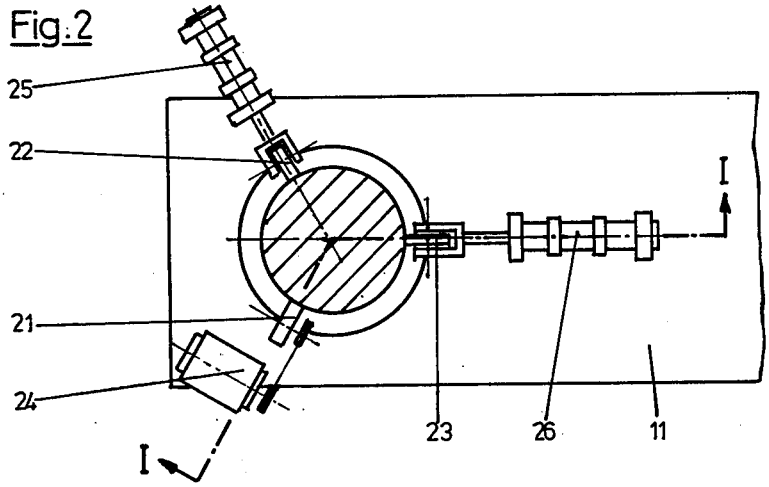
FIG. 2 shows the cross-section II—II of the electrode according to FIG. 1.
Figure 3:
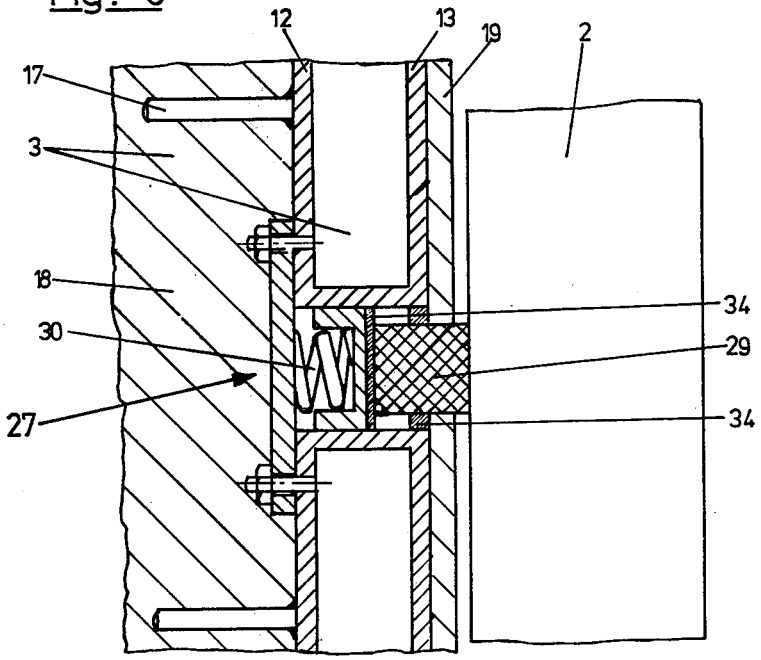
FIG. 3 shows an enlargement of the detail III on FIG. 1.

The liquid-cooled electrode 1 according to FIGS. 1 to 3 contains a core 2 carrying the electrode current and a cover 3 designed as an independent component, which contains the conduit system 4 for the cooling liquid. Core 2 consists of a consumable material, such as graphite or carbon, and constitutes, as do the customary unprotected graphite electrodes, individual sections 6, 7 and 8 rigidly connected by nipples 5. The supply of the electrode current is effected in the usual manner by way of a high current tubular bus 9, which is electrically connected to the core 2, for example by a sleeve, in the upper region of said core. The arc issuing from the electrode tip has the reference symbol 10. The cover 3 containing the conduit system 4 for the cooling liquid is secured to an electrode supporting arm 11. The cover can also be supported by the electrode holder. In the illustrated case the conduit system 4 for the cooling liquid is formed by an outer hollow metal cylinder 12, an inner hollow metal cylinder 13 and dividing walls or baffles 14 to form liquid flow passages between the two hollow cylinders 12 and 13. The dividing walls or baffles can be disposed helically between the two hollow cylinders or they can extend in the axial direction of the cover. 15 and 16 refer to the connections for the intake and outlet of the cooling liquid.

Instead of the conduit system illustrated in FIG. 1, other types of conduit systems can of course also be used, particularly distinct cooling tubes, which are arranged for example helically or in a cage-like way.

Projections 17 are provided on the outer surface of the conduit system 4 facing the furnace chamber, said projections being covered by a fire-proof material 18. By distributing these projections as evenly as possible over the periphery and in an axial direction there is achieved on the one hand a more even cooling of the fire-proof material and on the other hand a better securing of this material. An insulating layer 19 is present between the core 2 carrying the electrode current and the cover 3 in the present case, by means of which layer the conduit system 4 is electrically insulated from the core. Electrical contact between the conduit system 4 and the core 2 is also avoided by other ways. In this way the cover 3 and the supporting arm 11 can be kept at earth potential.

Since the core 2 and the cover 3 are designed as individual components their reciprocal axial position, in other words the dimension 20, by which the core tip projects out of the cover, can be easily adapted to suit the respective requirements and then the reciprocal position of the components to one another can be fixed. In the present case the core is formed from a consumable material, which requires the constant readjustment of dimension 20. For this reason, in the selected embodiment the core 2 can be displaced within the cover and a holding device is provided for the core 2, which is simultaneously designed as an advancing and guiding device. It consists of three rollers 21 to 23 distributed evenly around core 2, whereby roller 21 can be driven by a drive means 24 and the other two rollers 22 and 23 can be displaced in a radial direction by hydraulic cylinders 25 and 26 and can be pressed against the outer surface of the core and fixed in this position. The holding device is electrically insulated from the conduit system 4 for the cooling liquid. The holding device is secured to the electrode supporting arm 11 in the same manner as the cover 3. For the purpose of guiding the core within the cover 3 three guide means 27 are also provided in the lower region of the cover, being evenly distributed around the core and able to be flexibly pressed against the core. These guide means are expediently staggered along the periphery in relation to the rollers 21 to 23 at 60°. In the lower region of the cover 3 a device for producing a magnetic field is provided in the form of a permanent magnet or magnet excited by current 28. The magnetic field of the magnet is intended to cause the arc to move over the tip of the core.

Before starting up an electric melting furnace with electrodes in accordance with the invention the dimension 20, which measures the extent of projection of the core tip out of the cover, is first adjusted by means of the holding and advancing device. In doing so, not only the desired cooling conditions produced by the cover but also the position of the magnetic field determined by the position of the magnet 28 should be taken into account. If, during operation, the consumable core tip is slowly used up and thus the optimum tip projection dimension 20 is reduced, then the core can be displaced further in a downward direction by means of the advancing device step-wise or continuously. At the same rate at which the consumable core tip is used up below, a new piece is attached above by means of a nipple 5 so that in the best operating conditions no interruption is required for the replacement of a used-up electrode tip. There is no consumable core residue as with the known electrodes with interchangeable, consumable tips.

FIG. 3 represents an enlargement of the detail III on FIG. 1, it shows therefore in detail the constructional form of one of the guide means 27 provided in the lower region of the cover 3 and which can be flexibly pressed against the core 2. The guide means are formed from cylindrical graphite elements 29 which can be radially displaced in the cover 3, said elements being pressed against the core 2 by a spring 30. Insulating layers 34 achieve the desired reciprocal insulation of core 2 and cover 3, thereby permitting the cover to be kept at earth potential.

Figure 4:
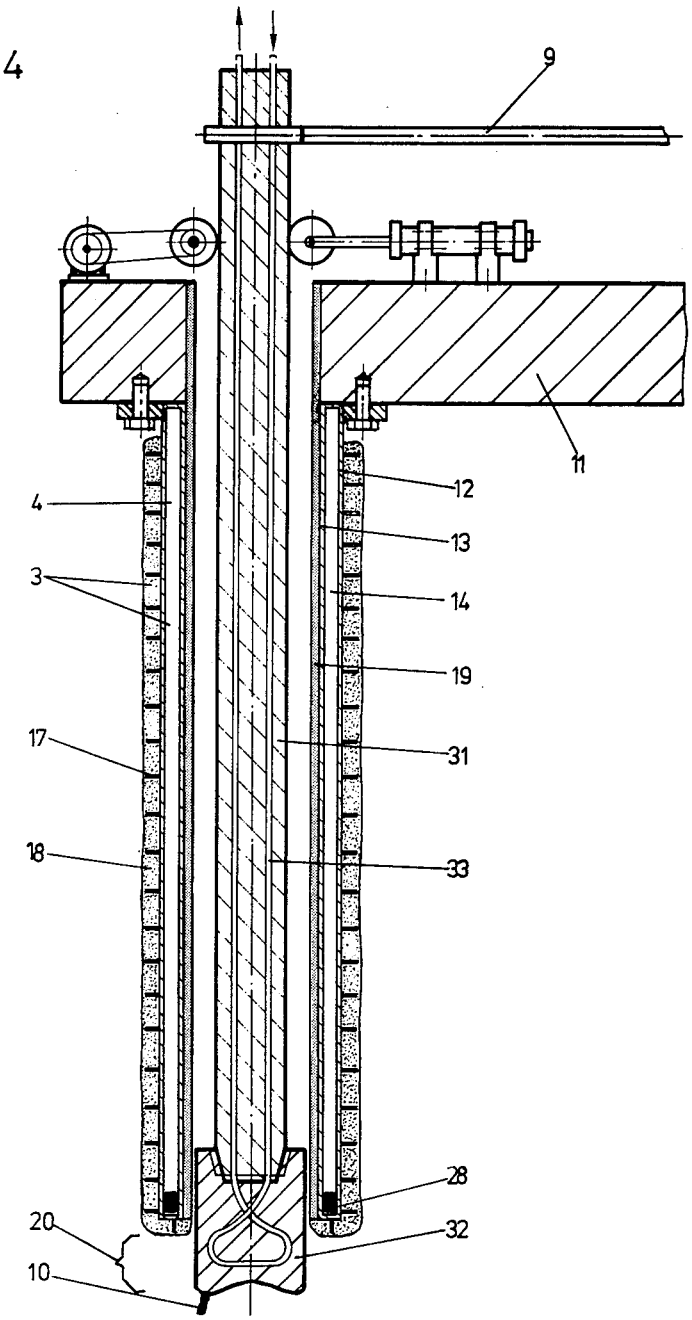
FIG. 4 shows the longitudinal section of another electrode in accordance with the invention with a non-consumable electrode tip.

The embodiment of an electrode in accordance with the invention represented in longitudinal section on FIG. 4 differs from the embodiment represented on FIG. 1 in the use of a core 31 and an electrode tip 32 of metal instead of a consumable material. Here also, the core 31 in the form of a metal element carries the electrode current and inclusive of its tip 32 is electrically insulated from the cover 3. Since the tip 32 does not act as a consumable electrode tip it must be cooled. Therefore, an additional conduit system 33 is provided inside the core 31, is electrically insulated from the conduit system 4 of the cover and cools the tip 32 of the core. After adjustment of the dimension 20, which measures the degree of projection of the tip 32 of the core 31 out of the cover 3, there is generally no need to perform a further axial displacement of the core inside the cover so that in this case the advancing device for this electrode core can be omitted.

We claim:

1. A liquid-cooled electrode for electric arc furnaces, comprising: an electrode supporting arm, a cover secured to said electrode supporting arm and adapted to contain cooled metal elements, a core axially displaceable in said cover, a current connection for conducting electric current into said core, said current connection being disposed above said cover, means for electrically insulating said cover from said core and including an insulating layer between said cover and said core, and a device for producing a magnetic field and provided in the lower portion of said cover.

2. An electrode according to claim 1, comprising a conduit system for cooling liquid and arranged in said cover, said electric arc furnace comprising a furnace chamber, and fire-proof material interposed between said conduit system and said furnace chamber.

3. An electrode according to claim 2, wherein said conduit system has an outer surface facing said furnace chamber, projections on said outer surface and covered by said fire-proof material.

4. An electrode according to any one of claims 1 to 3, wherein said core carrying the electrode current comprises a consumable material selected from the group consisting of graphite, carbon and the like.

5. An electrode according to any one of claims 1 to 3, wherein said core carrying the electrode current comprises a non-consumable metal element, and having a tip, and means for at least water-cooling said tip.

6. An electrode according to any one of claims 1 to 3, wherein said conduit system comprises an outer and an inner hollow metal cylinder, and at least one dividing wall for the formation of liquid flow passages between said two hollow cylinders.

7. An electrode according to any one of claims 1 to 3, wherein said conduit system is formed from cooling tubes.

8. An electrode according to any one of claims 1 to 3, wherein said conduit system is formed from cooling passages.

9. An electrode according to claim 8, wherein said cover comprises a graphite element containing cooling passages.

10. An electrode according to claim 9, wherein a fire-proof material coats the graphite element on its surface facing the furnace chamber.

11. An electrode according to any one of claims 1 to 3, including a holding device for the core, said holding device comprising an advancing and guiding device at the upper end of said cover.

12. An electrode according to any one of claims 1 to 3, including a holding device for the core, said holding device comprising an advancing and guiding device at the upper end of said electrode supporting arm.

13. An electrode according to claim 11, wherein said holding device supplies current to the core.

14. An electrode according to claim 12, wherein said holding device supplies current to the core.

15. An electrode according to claim 11, wherein said holding device comprises a roller outwardly of said core, and means for driving said roller and for displacing said roller in a radial direction and for pressing said roller against the outer surface of the core.

16. An electrode according to claim 12, wherein said holding device comprises a roller outwardly of said core, and means for driving said roller and for displacing said roller in a radial direction and for pressing said roller against the outer surface of the core.

17. An electrode according to claim 11, wherein said holding device comprises a plurality of rollers distributed around said core, means for driving at least one of said rollers and for displacing at least one of said rollers in a radial direction and for pressing at least one of said rollers against the outer surface of said core.

18. An electrode according to claim 12, wherein said holding device comprises a plurality of rollers distributed around said core, means for driving at least one of said rollers and for displacing at least one of said rollers in a radial direction and for pressing at least one of said rollers against the outer surface of said core.

19. An electrode according to any of claims 1 to 3, comprising a plurality of guide means distributed around the core and provided in the lower region of said cover, and means for pressing at least one of said guide means against the core.

20. An electrode according to claim 19, wherein said guide means comprises graphite elements arranged radially displaceable in the cover, said pressing means comprising a spring.

* * * * *